US006069450A

United States Patent [19]

Sakai et al.

[11] Patent Number: 6,069,450

[45] **Date of Patent: *May 30, 2000**

[54] DRIVING METHOD FOR ELIMINATING THE CONTAMINATION OF DISPLAYED IMAGES IN THE VERTICAL DIRECTION IN DRIVING DC PLASMA DISPLAY PANELS IN A DC MODE

[75] Inventors: Tetsuo Sakai; Byung Moon Jung, both of Tokyo, Japan

[73] Assignee: Hyundai Electronics Industries Japan Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,760

[22] Filed: Jul. 24, 1997

[30] Foreign Application Priority Data

Jul. 24, 1996 [JP] Japan ..... 8-213238

[51] Int. Cl.[7] ..... H05B 41/00; H05B 41/36; G09G 3/10; G05F 3/00

[52] U.S. Cl. ..... 315/169.1; 315/169.4; 315/291

[58] Field of Search ..... 315/169.1, 169.3, 315/169.4, 260, 261, 291, 324, 334–337

[56] References Cited

U.S. PATENT DOCUMENTS 4,152,626 5/1979 Hatta et al. ..... 315/169.3 X
4,479,120 10/1984 Ohba et al. ..... 340/781
4,691,144 9/1987 King et al. ..... 315/169.3

FOREIGN PATENT DOCUMENTS 48-31094 4/1973 Japan .

OTHER PUBLICATIONS

Hiroshi Murakami, "A Color TV Display Using an 8–Inch Pulse Discharge Panel", The Journal of the Institute of Television Engineers of Japan, 1984, pp. 837–838.

T. Sakai, "Positive Column Cell PDP and its DC mode memory driving", The Institute of Electronics, Information and Communication Engineers, Technical Report of IEICE, EID96–21, 1996, pp. 51–56.

*Primary Examiner*—David Mis
*Attorney, Agent, or Firm*—Jacobson, Price, Holman & Stern, PLLC

[57] ABSTRACT

A method of driving DC plasma display panels according to a DC mode memory system is provided. According to the method, a compensation pulse for eliminating or reducing the contamination of a displayed image resulting from the application of a write pulse is applied to a position close to the write pulse. The method of the present invention has various advantages that the contamination of a displayed image generating in a direction normal to the display screen is eliminated or reduced; when the method is performed according to a DC mode memory system, the light-emission time can be concentrated to reduce the generation of false outlines so that the general image quality can be remarkably improved; and the electrical power required for the application of the maintenance pulse can be saved to thereby improve efficiency.

8 Claims, 5 Drawing Sheets

DRIVING METHOD FOR ELIMINATING THE CONTAMINATION OF DISPLAYED IMAGES IN THE VERTICAL DIRECTION IN DRIVING DC PLASMA DISPLAY PANELS IN A DC MODE

BACKGROUND OF THE INVENTION

1. Field of the Invention

The present invention relates to a method of driving DC plasma display panels, and more particularly, to a method of driving a DC plasma display panel according to a DC memory system wherein a compensation pulse for reducing the contamination of a displayed image taking place by the application of a write pulse is applied near the write pulse so that the apparent output of light-emission is reduced to eliminate the contamination phenomenon and also to reduce the generation of false outlines with respect to a displayed image.

2. Description of the Related Art

Conventionally, there have been proposed a DC plasma display panel driving method according to a pulse memory system wherein a sustain pulse is applied on a display anode in the connection diagram shown in FIG. 3 at a timing shown in the time chart in FIG. 4 and a DC plasma display panel driving method according to a DC mode memory system in which a write pulse is applied on a display anode at a timing shown in FIG. 5.

First, to describe the operation of the arrangement shown in FIGS. 3 and 4, reference numeral 11 designates a cathode bus, reference numeral 12 designates a scanning (auxiliary) anode bus and reference numeral 13 designates a display anode bus. Reference numeral 14 designates a scanning cell which is provided at each point of intersection of the cathode bus 11 and the scanning anode bus 12 and reference numeral 15 designates a display cell which is provided at each point of intersection of the cathode bus 11 and the display anode bus 13. Further, in each of the display cells 15 there is inserted in series a resistor 22 for discharge stabilization. In some methods, such series-connected resistor 22 is also inserted into each scanning cell 14 which, however, is omitted herein. Thus, a write pulse 17 is applied on the display anode bus 13 which is being applied with a maintenance pulse 16 and at the same time, a scanning pulse 18 and an erasing pulse 19 are applied on the cathode bus 11 to thereby display an image on a memory panel 20.

Further, when driving according to the DC memory mode in FIG. 5, a predetermined sustain voltage is applied on the display anode bus 13 and at the time of writing, a write pulse 21 is applied on the bus 13.

It is noted that the black-painted portions of the scanning cells and the display cells show that they are in the state of discharging.

Of the above-mentioned two conventional methods, the first method is disclosed in the Journal of the Institute of Television Engineers of Japan (April 1984, p. 332 by Murakami, et. al.) and the second method is described by the inventor of the present invention in his Ph.D. thesis entitled "A Study of Providing High Performance to the DC Discharge Type TV Display Panel" (Ph.D. Thesis, Tohoku University, February, 1994, p. 25).

Particularly, the second method of driving according to the DC mode memory system has had the drawback that the presence of the write pulse increases the discharge current of the cell which continues to discharge for maintenance, so that the brightness of the displayed image intensifies to cause a contamination phenomenon in the vertical direction to generate.

The present invention has been made in view of the above-described situation and an object of the present invention is to provide a method of driving DC plasma display panels which method is capable of eliminating the contamination of a displayed image in the vertical direction and making the displayed image clear and distinct.

SUMMARY OF THE INVENTION

In order to achieve the above-described object, the present invention provides a method of driving a DC plasma display panel according to a DC mode memory system which is characterized in that a compensation pulse is applied close to a write pulse so that the contamination of a display image taking place by the application of the write pulse is reduced or eliminated.

The method of the present invention is further characterized in that the polarity of the compensation pulse is different from that of the write pulse, the compensation pulse is applied directly after the application of the write pulse and the level of amplitude of the compensation pulse is close to the discharge stop level of a scanning cell.

DETAILED DESCRIPTION OF THE INVENTION

Figure 1:
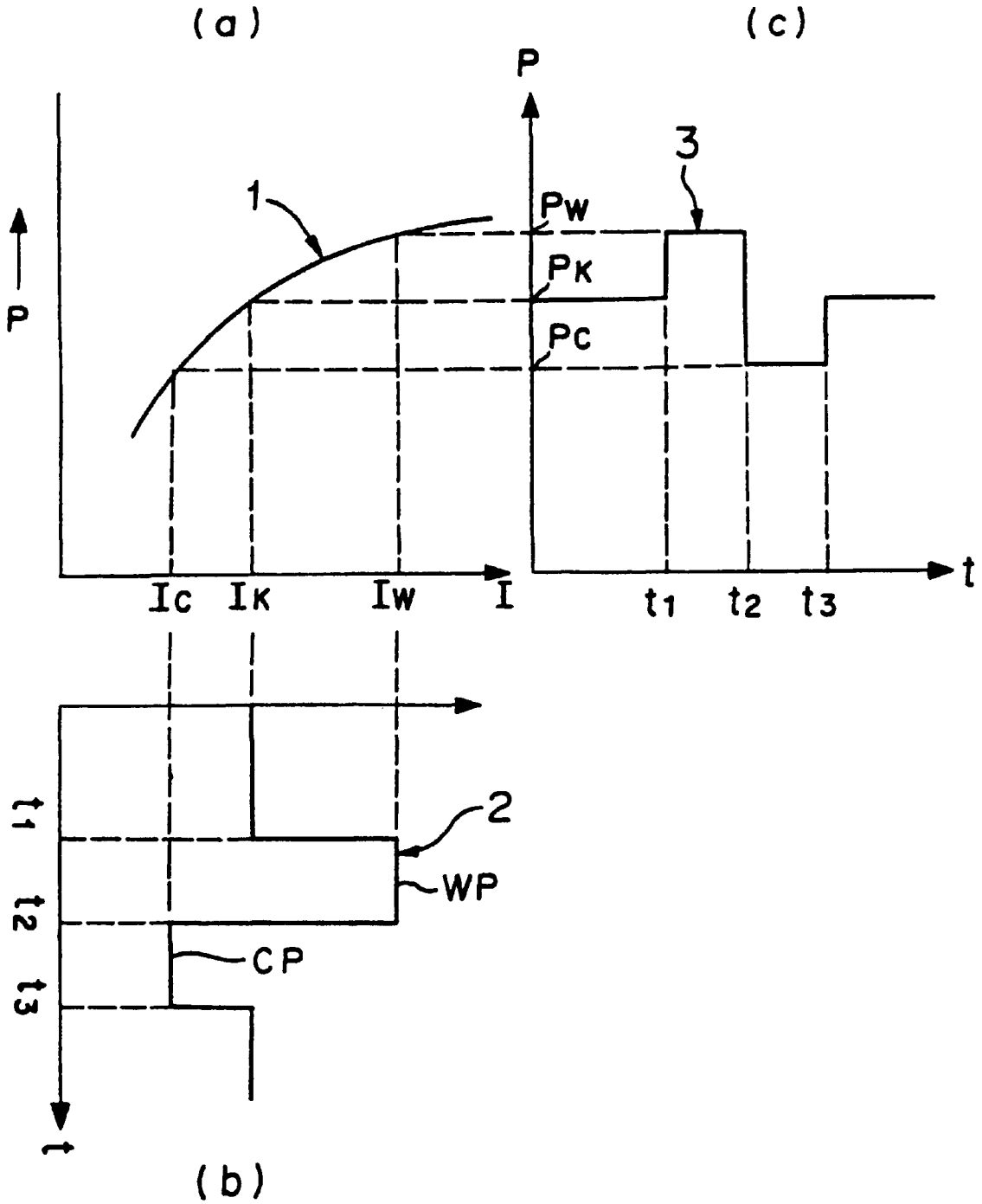
FIG. 1 is a diagram showing a relationship between a drive waveform obtained when a compensation pulse is applied, and an output of light emission.

A method of driving a DC plasma display panel according to the present invention will now be described by referring to FIGS. 1 and 2.

In the figures, reference numeral 1 designates a characteristic curve of a light-emission output P plotted against a discharge current I of a cell. Reference numeral 2 designates a waveform I(t) of a drive current to be applied on a display anode in place of a write pulse $DA_2$ in FIG. 5 and reference numeral 3 designates a waveform P(t) of the light-emission output P.

It should be noted that the description of the present invention is based on the assumption that there is no afterglow.

The cell has a series-connected resistor and a sustain voltage of the cell itself does not change so much with respect to a current change. Further, since the relationship between the anode drive voltage V(t) and the drive current I(t) is substantially expressed by a linear equation, the waveform of the drive current I(t) may be considered equal to that of the anode drive voltage V(t).

Figure 2:
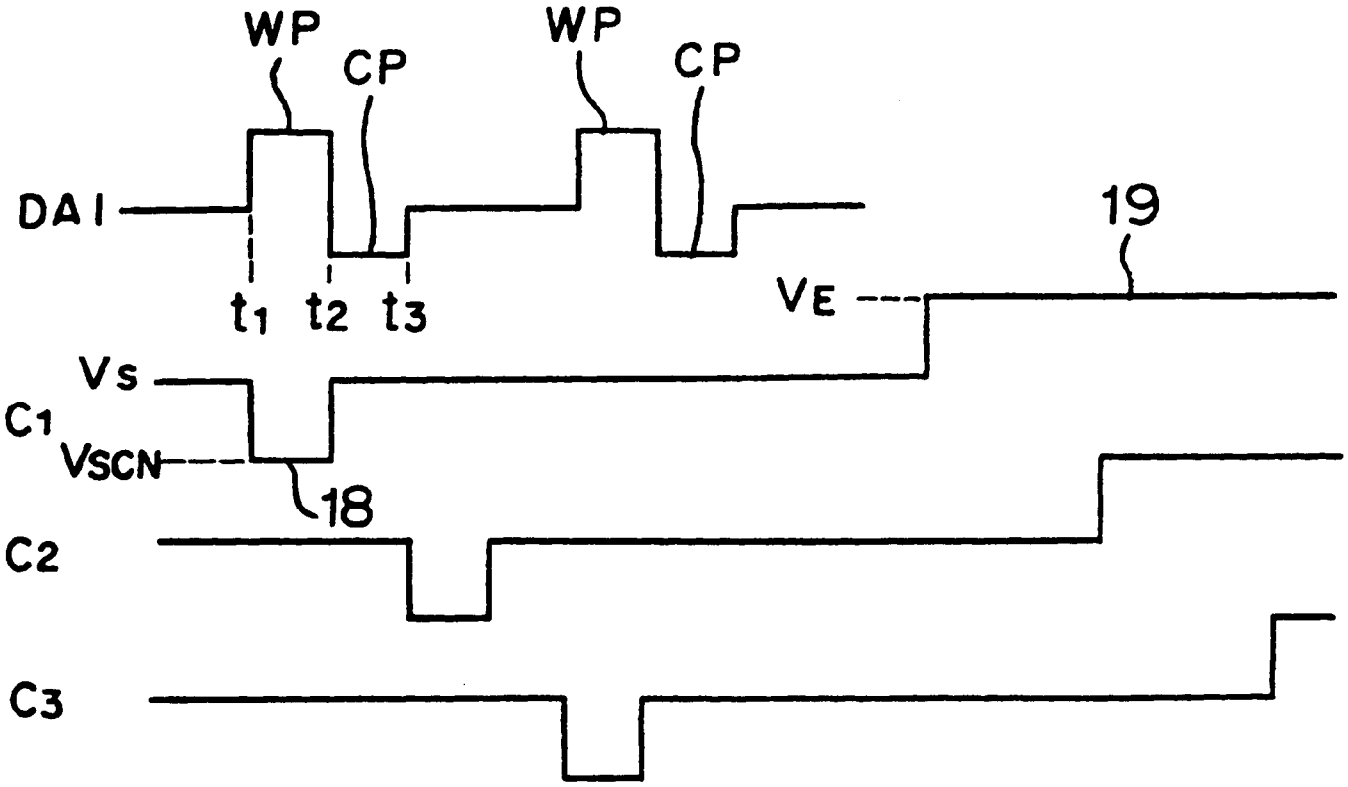
FIG. 2 is a waveform diagram illustrating another embodiment of the present invention.
Figure 3:
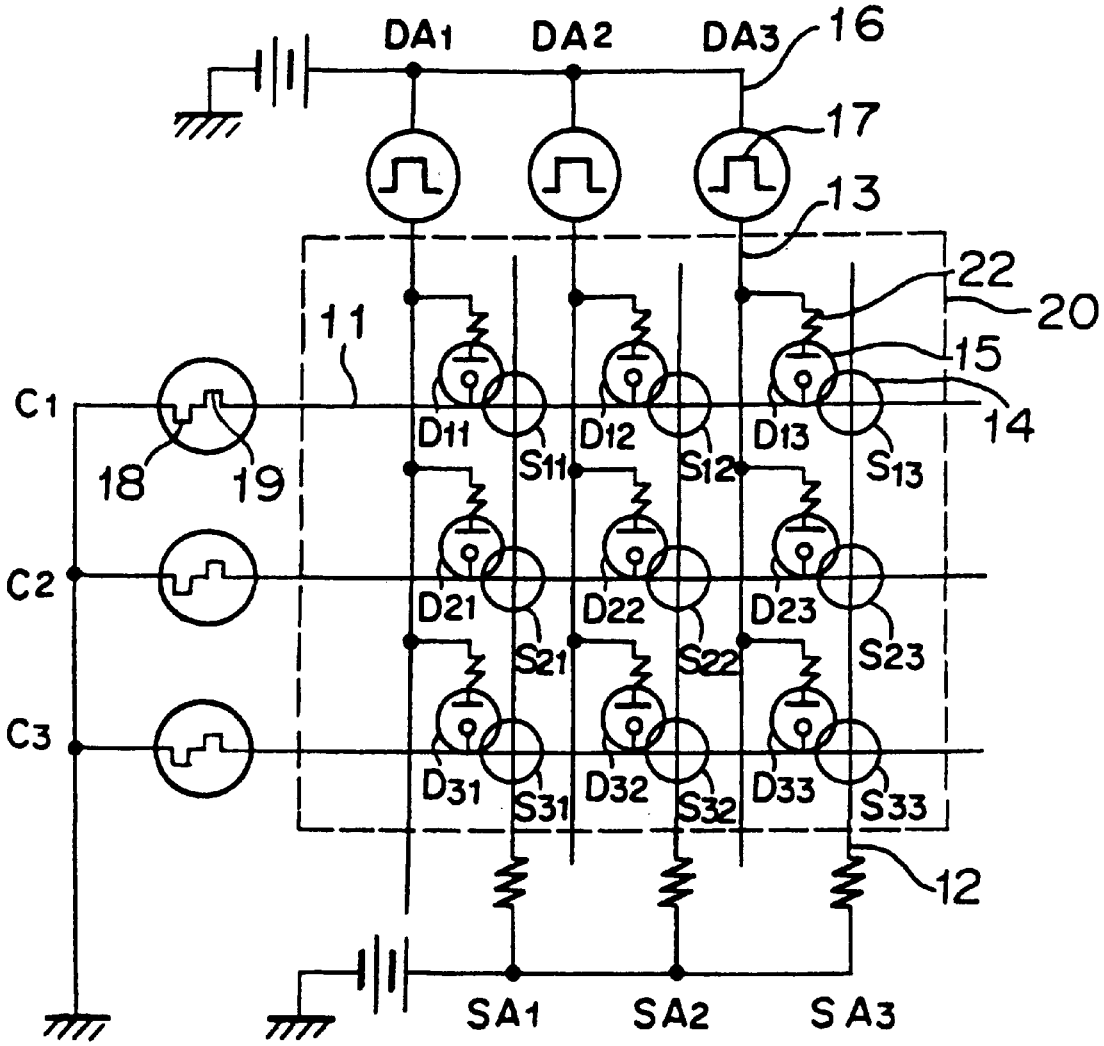
FIG. 3 (PRIOR ART)
FIG. 3 is a connection diagram for driving a memory panel according to a conventional method.
Figure 4:
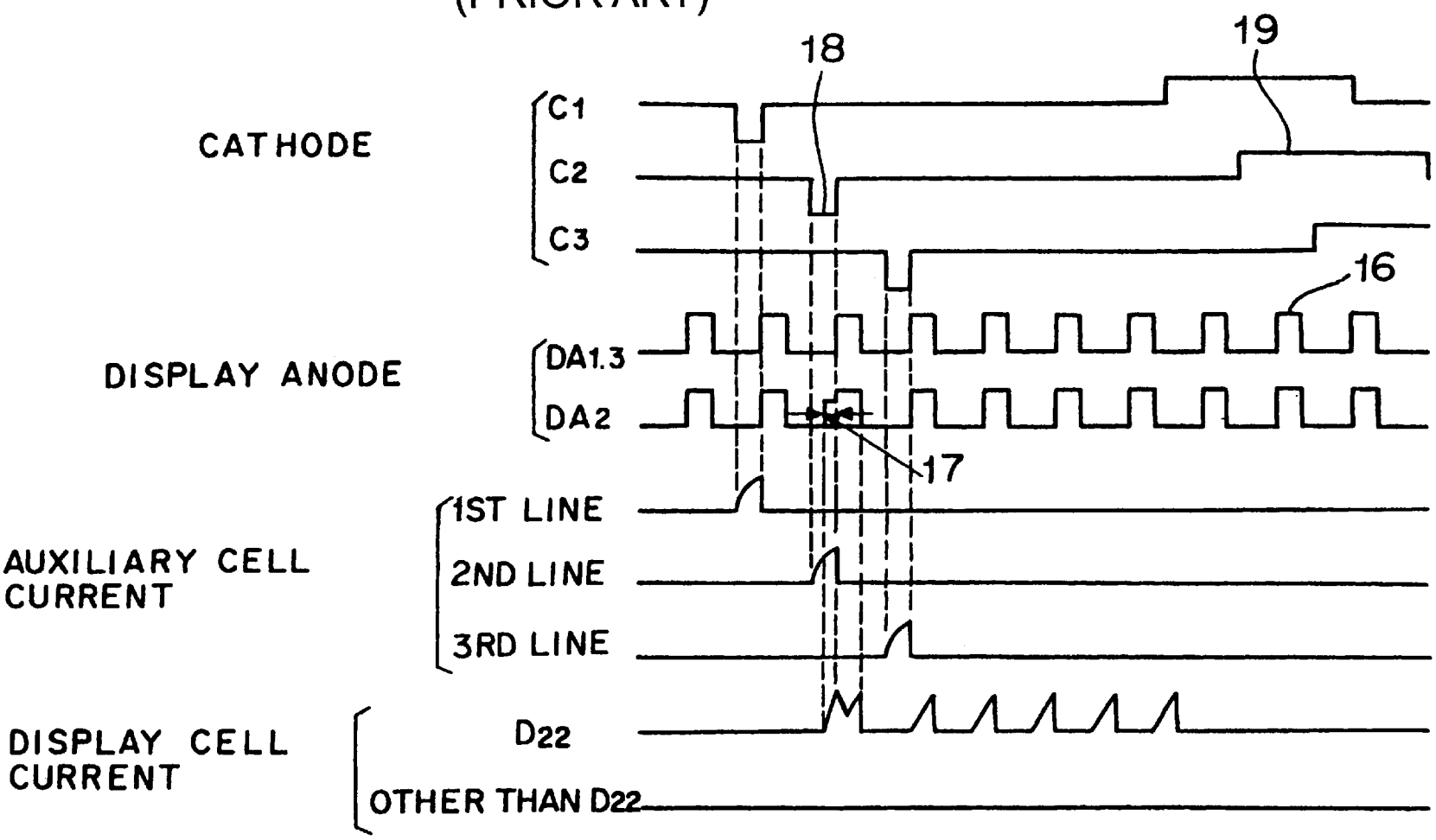
FIG. 4 (PRIOR ART)
FIG. 4 is a time chart at the time when the pulse memory panel of FIG. 3 is driven.

Further, a symbol WP in FIGS. 1 and 2 designates a write pulse and at a position near the write pulse WP, a compensation pulse CP of the present invention is applied directly after the application of write pulse WP in a direction in which the polarity of the compensation pulse differs from that of the write pulse WP.

Reference symbol $I_K$ designates a maintenance current, reference symbol $I_W$ designates a current at the time when the write pulse is present, reference symbols $P_K$, $P_W$ and $P_C$ designate light-emission outputs, respectively, at the time of maintenance, writing and compensation, and reference symbols $t_1$, $t_2$ and $t_3$ designate times following the writing pulse WP and the compensation pulse CP, respectively.

When the compensation pulse CP is absent, the light-emission output $P_W$ increases to cause a turbid phenomenon to take place. On the other hand, when the compensation pulse CP is present, if the equations of:

$$P_w - P_K = P_K - P_C$$

and $$t_2 - t_1 = t_3 t_2 = T$$

are established, an increase in the quantity of light due to the application of the write pulse WP and a decrease in quantity of light by the application of the compensation pulse CP cancel each other to keep the value of the light-emission output $P_K$ on an average. The value of T in this case is about 100 $\mu$s or so at the highest so that the light-emission output $P_K$ which is a completely averaged output is visually sensed and the contamination phenomenon is eliminated.

In FIG. 1, the waveform of the increment of the light-emission output and that of the decrement of the light-emission output are shown to become symmetrical with each other, but if the area of the concave portion (decrement) of the waveform is equal to that of the convex portion (increment), the object intended by the present invention can be achieved. Further, even if the two areas are not equal to each other, it is apparent that the contamination phenomenon can be mitigated.

Figure 5:
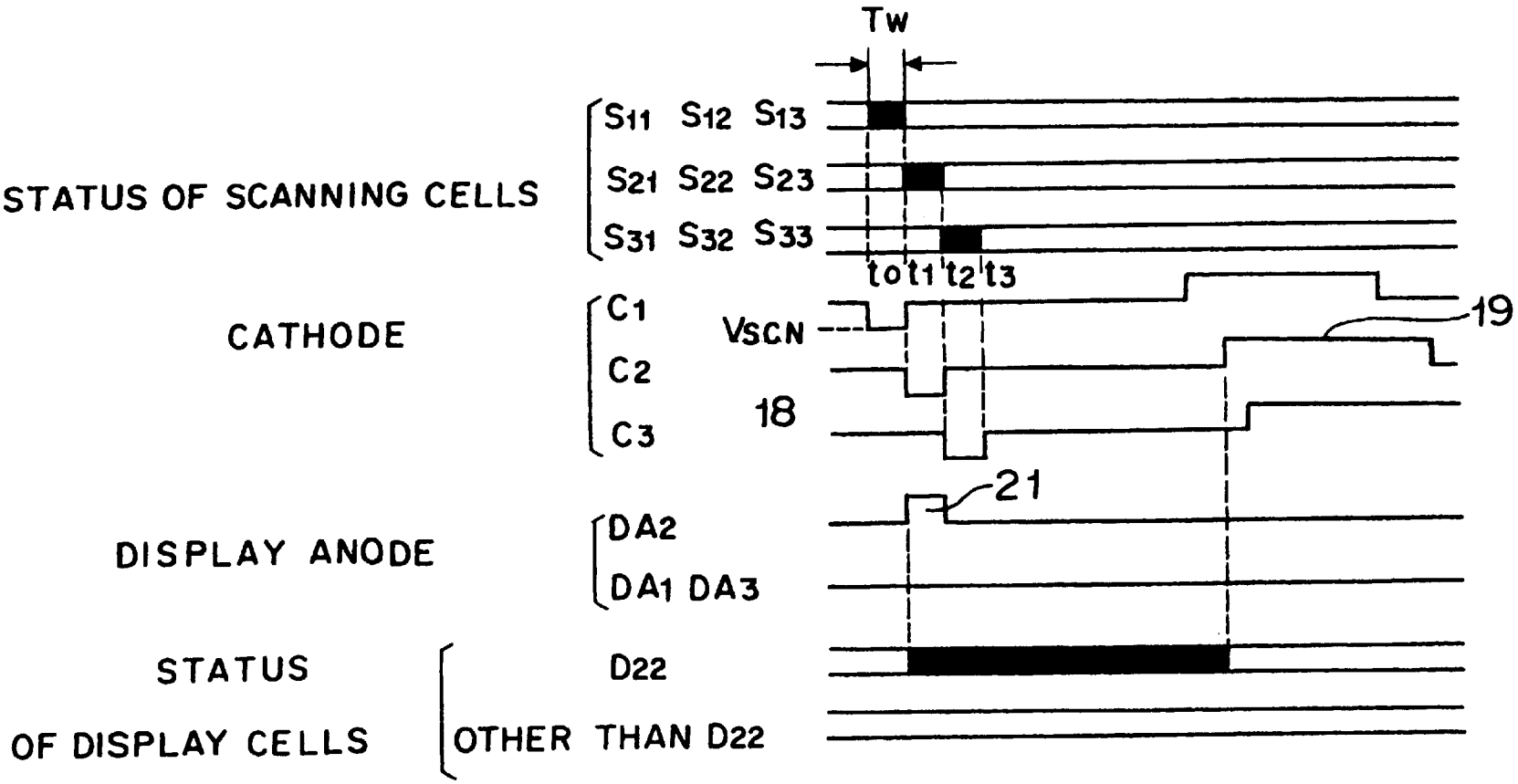
FIG. 5 (PRIOR ART)
FIG. 5 is a time chart of a conventional DC mode memory.

Further, as shown in FIG. 5, the cathode side scanning pulse 18 may be made to take a negative value (VSCN) during the period of time TW to thereby make $t_3 - t_1$ shown in FIG. 1 equal to TW, but as shown in FIG. 2, the scanning pulse 18 may be made so only during the time in which the write pulse is present. Note that in FIG. 2, memory panels $D_{11}$ and $D_{31}$ are set to be write and $D_{21}$ is set to be non-write, respectively.

It should be noted that in the foregoing description, it is assumed that the light-emission output has no afterglow but in the case of a fluorescent material with which ultraviolet rays can be converted to visible rays, there exists a considerable degree of afterglow with saturation characteristics.

However, the light-emission output of ultraviolet rays is considered to be the light-emission output P(t) in FIG. 1, since such output P(t) shows itself a change in the emission of light taking place in a short time, the output is averaged by the fluorescent material to thereby compensate for such change.

Further, although it is shown in FIG. 1 that the compensation pulse CP is applied directly after the application of the write pulse WP, it may be applied prior to the write pulse WP. In that case, the rise of the write cell is slightly influenced thereby so that it is preferable to apply it after the write pulse.

Further, the level of amplitude of the compensation pulse CP may be set to a value directly before the scanning cell 14 stops discharging. When the compensation pulse CP is present, it is advantageous to make the discharge current as small as possible to thereby narrow the width of the pulse because by so doing, the address speed increases.

It is noted that the DC plasma display panel driving method according to the present invention can also be applied to a scanning method as disclosed in Japanese unexamined patent publication No.S48-31094. In that case, it is possible to concentrate the light-emission time and to reduce the generation of false outlines.

The DC plasma display panel driving method according to the present invention has various advantages in that it is possible to eliminate or reduce the contamination of an image taking place in a direction normal to the screen and in the case of the DC mode driving method, the general image quality can be improved remarkably since the light-emission time can be concentrated and the generation of false outlines is reduced and, since the method makes use of a DC mode, the electrical power required for the sustain pulse can also be reduced to thereby improve efficiency.

What is claimed is:

1. A method of driving a DC plasma display panel comprising applying a write pulse to the DC plasma display panel to display an image and applying a compensation pulse directly before or after the write pulse so that contamination of the displayed image taking place by the application of said write pulse is reduced.

2. The method of driving a DC plasma display panel according to claim 1, wherein polarity of said compensation pulse is different from polarity of said write pulse.

3. The method of driving a DC plasma display panel according to claim 1, wherein said compensation pulse is applied directly after the applying said write pulse.

4. The method of driving a DC plasma display panel according to claim 1, wherein the level of the amplitude of said compensation pulse is substantially equal to the level of discharge stop of a scanning cell.

5. A method of driving a DC plasma display panel comprising applying a write pulse to the DC plasma display panel to display an image and applying a compensation pulse directly adjacent to the write pulse so that contamination of the displayed image taking place by the application of said write pulse is reduced.

6. The method of driving a DC plasma display panel according to claim 5, wherein polarity of said compensation pulse is different from polarity of said write pulse.

7. The method of driving a DC plasma display panel according to claim 5, wherein said compensation pulse is applied directly after the applying said write pulse.

8. The method of driving a DC plasma display panel according to claim 5, wherein the level of the amplitude of said compensation pulse is substantially equal to the level of discharge stop of a scanning cell.

* * * * *